United States Patent [19]

Ingram

[11] Patent Number: 4,821,666

[45] Date of Patent: Apr. 18, 1989

[54] FOLDING KAYAK

[76] Inventor: Robert T. Ingram, SS 1 Site 7 Comp 19, Penetang, Ontario, Canada, L0K 1P0

[21] Appl. No.: 129,584

[22] Filed: Dec. 7, 1987

[30] Foreign Application Priority Data

Jul. 3, 1987 [CA] Canada ..... 541193

[51] Int. Cl.[4] ..... B63B 35/00

[52] U.S. Cl. ..... 114/347

[58] Field of Search ..... 114/347, 351, 352, 353, 114/354, 355, 359, 361

[56] References Cited

U.S. PATENT DOCUMENTS 3,869,743 3/1975 Brown et al. ..... 114/354

FOREIGN PATENT DOCUMENTS 269290 4/1927 United Kingdom ..... 114/354

504892 5/1939 United Kingdom ..... 114/354

*Primary Examiner*—Sherman D. Basinger

*Assistant Examiner*—Jesûs D. Sotelo

[57] ABSTRACT

Folding kayak cover provides storage access to the full length of the kayak interior by means of the same fasteners attached to the cover which stretch the cover transversely and longitudinally over the assembled, non-expanding frame, which has a deck ridge. These fasteners, comprising lengths of material such as straps with buckles or lacing, are spaced in two sets, along the full length of the deck where the cover overlaps, sandwiching a compressible gasket at the deck ridge and making a watertight seal. One set of fasteners release the overlapping part of the cover along the full length of the deck to expose for storage the openings between the fasteners of the other set which connect the underlying edge of the cover, on the deck ridge, to the non-overlapping part of the cover next to the nearest gunwale.

2 Claims, 3 Drawing Sheets

FOLDING KAYAK

BACKGROUND OF THE INVENTION

1. Field of the Invention

The present invention relates to a cover which encloses the assembled frame of a folding kayak tightly using two sets of fasteners attached to the cover and the same fasteners allow storage access to the interior of the kayak's entire length once it is assembled.

2. Prior Art

Various covers exist for folding kayak frames. One type depends upon the expansion of the frame to fit the cover tightly. Another type requires inflation of air bladders to fit the frame to the cover tightly. Over types combine both an expanding frame and air bladders to ensure that the cover fits tightly around the frame. These covers are complicated and expensive to manufacture as they require precise fitting to the expanded frame as well as, possibly, air bladders. The precise fit may make enclosure of the frame difficult, particularly when new, as the cover may be expected to stretch in order that a loose fit does not occur after repeated use. The frames of these kayaks are complicated and expensive to manufacture. The covers of these kayaks lack adequate means to store supplies below deck, fore and aft.

It is desireable to have a cover for the frame of a folding kayak which is simple and inexpensive to manufacture, requiring no precise fit to the assembled frame, as it encloses the frame tightly using its own fasteners. It is desirable that a cover require a frame which is also simple and inexpensive to manufacture; not expanding or changing in any way, once assembled. The simplicity of the frame and cover increase ease of repair, assembly and disassembly. The weight of the assembled kayak is minimized by the components of the frame and cover having no other function than the strength of the structure. It is also desirable to have a means of access below deck for storage inside the assembled kayak, at no additional cost or complexity, this function is performed by the same fasteners.

SUMMARY OF THE INVENTION

The present invention consists of a cover for a folding kayak with two sets of fasteners which stretch the cover over the assembled frame with a deck ridge and provide storage access to the full length of the kayak interior. The fasteners, made of lengths of material such as straps with buckles or cord, attach to the cover along the full length of the deck where the cover overlaps and sandwiches a compressible gasket at the deck ridge, making a watertight seal. The first set of fasteners, spaced along the full length of the deck including both ends, connect the underlying edge of the cover, lying on the deck ridge, to the non-overlapping part of the cover next to the nearest gunwale and stretch the cover over the frame transversely and longitudinally. The second set of fasteners tighten to compress the gasket along the deck ridge with the overlapping part of the cover and release the overlapping part of the cover to expose the openings between the first set of fasteners, for storage access.

The material of the cover is suitably strong and flexible. It may be vinyl, hypalon, nylon, or any other material commonly used for folding kayaks or inflatable boats. The fasteners must also be suitably strong and flexible to assist enclosure of the frame. The gasket must also have strength and flexibility, as provided by a neoprene gasket, for example. It is desireable to minimize the weight of all materials used, to enhance the portability of the craft. It must be possible to repair the cover, fasteners and gasket with minimal tools and materials under wilderness conditions.

The material of the frame must minimize weight without sacrificing strength or economy of manufacture. Cross-members may be cut from marine plywood. Longitudinal stringers may be sections of aluminum tubing. It must be possible to repair the frame under wilderness conditions, easily, with a minimum of tools and material.

The simplicity of design for both the cover and the frame increases the ease of repair under wilderness conditions, during expeditions, when a minimum of tools and repair materials are carried.

The invention, as exemplified by a preferred embodiment, is described with reference to the drawings in which:

DETAILED DISCLOSURE

Figure 5:
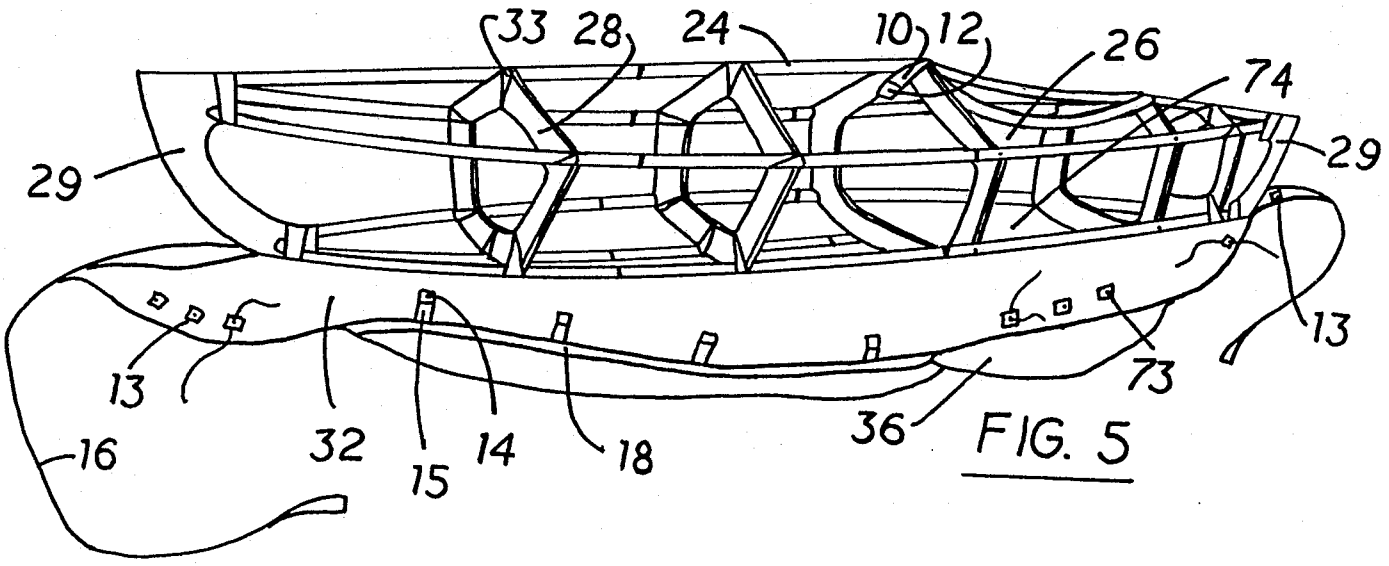
FIG. 1 and FIG. 5 are simplified, perspective views of an embodiment of a folding kayak cover during enclosure of an assembled frame the first set of fasteners connecting the underlying edge of the cover to the nearest gunwale and both ends of the cover to the cockpit frame being tightened.
Figure 1:
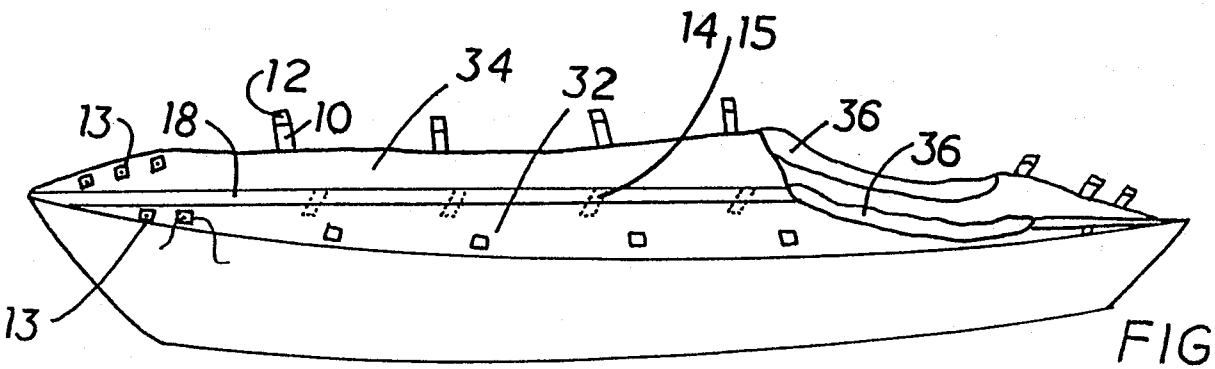
Figure 2:
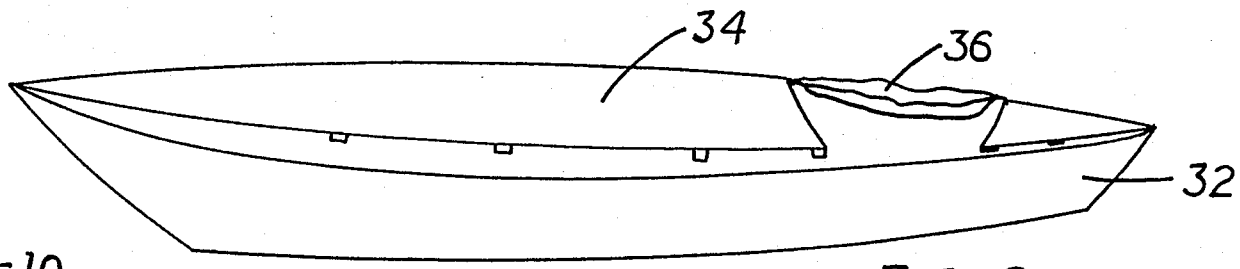
FIG. 2 is a simplified, perspective view of an embodiment of a folding kayak cover after the second set of fasteners have been tightened along the deck and the overlapping part of the cover is secured by these fasteners along the nearest gunwale.
Figure 4:
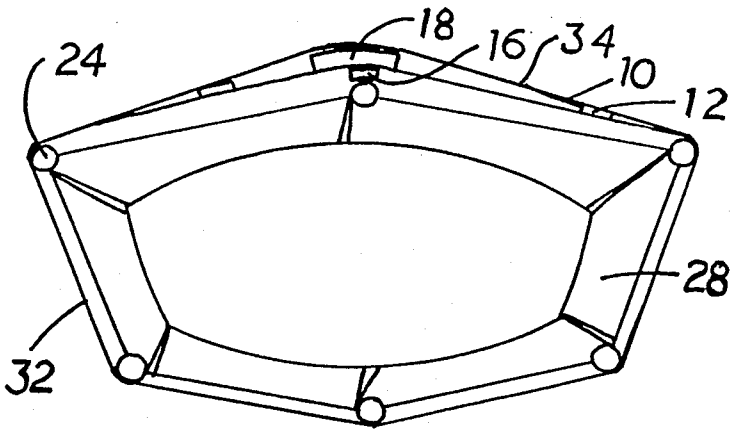
FIG. 3 and FIG. 4 are simplified, cross-section views of an embodiment of a folding kayak cover, showing it enclosing an assembled frame.
Figure 3:
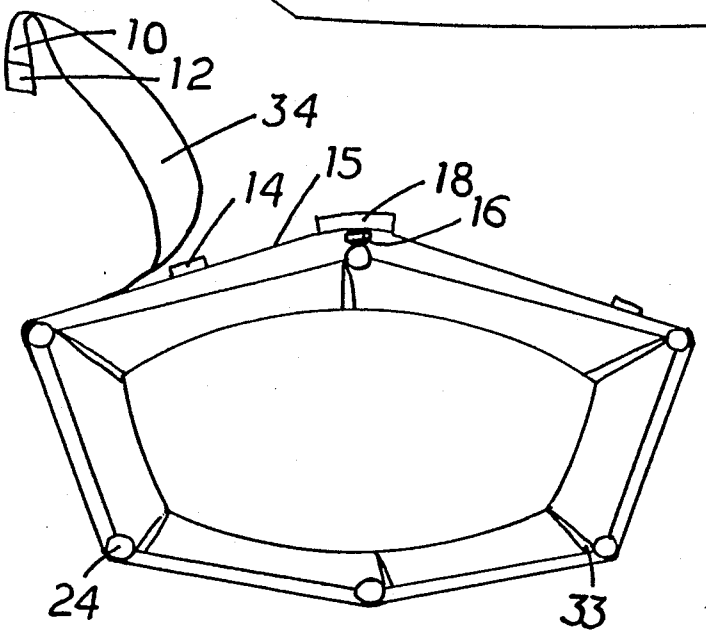
Figures 6, 7, 8, 9:
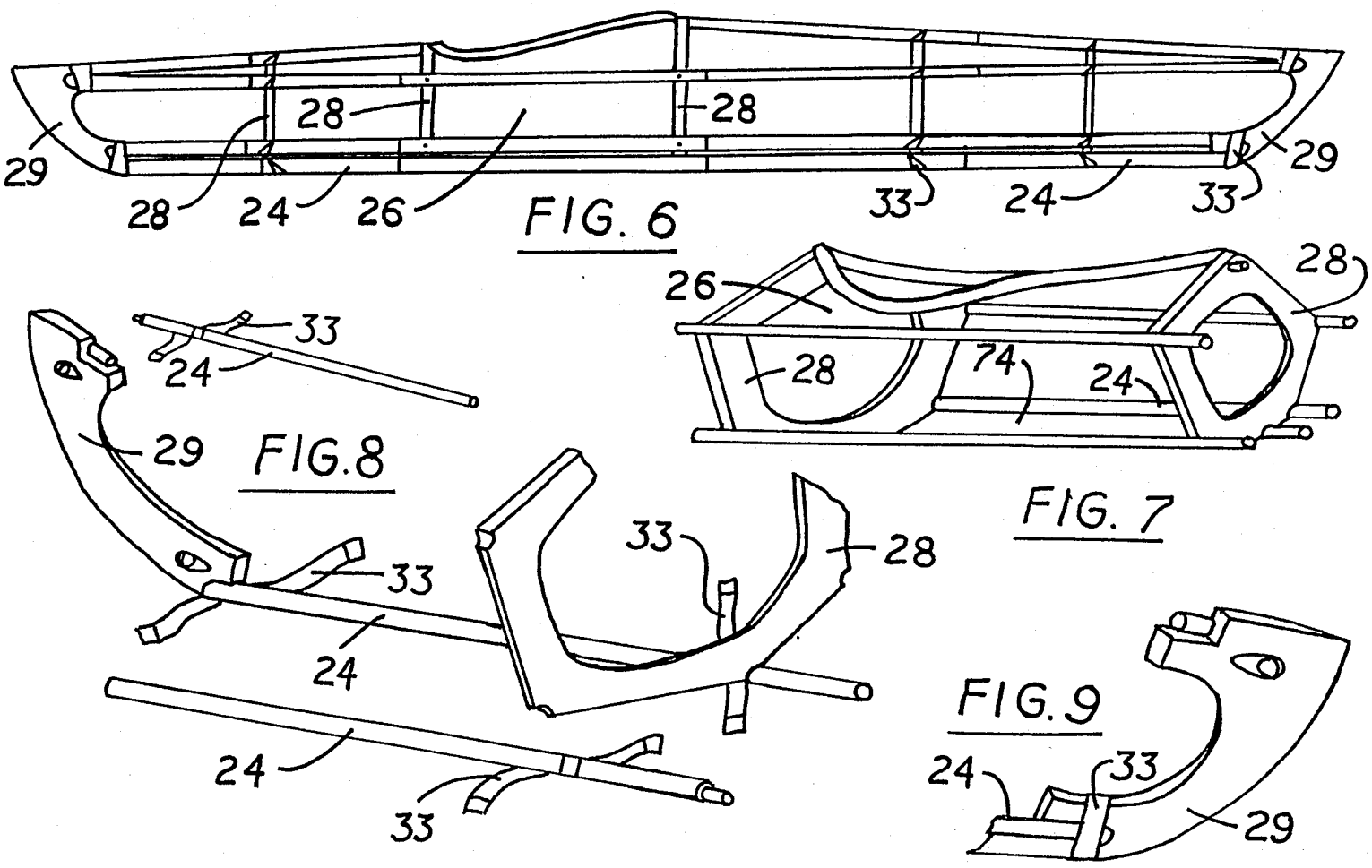
FIG. 6, 7, 8, and 9 are simplified views of a frame showing a side view of an assembled frame, fragmented views of a cockpit frame, stringers, end-pieces, and a cross-member.

Referring to the drawings, the embodiment of the invention shown, a folding kayak cover 32 comprises a plurality of tightening fasteners such as straps 10, 15 and buckles 12, 14 which may be Fastex (a Trade Mark) or Nifco (a Trade Mark) quick-release buckles, or lacing and eyelets at both ends 13, and adjacent the cockpit frame 73.

The folding kayak cover comprises a gasket 18 the first set of fasteners of fasteners, such as straps 15 and buckles 14 which are tightened first to position and secure the gasket 18 attached to the cover, along the deck ridge the full length of the deck and straps 16 connect the ends of the cover to the cockpit frame. Lacing and eyelets 73 tighten the cover adjacent the cockpit frame 26.

The folding kayak cover also comprises an overlapping part of the cover 34, secured along the gunwale by next tightening the plurality of fasteners 10, 12, 13.

The folding kayak cover comprises a spray skirt 36 which is permanently attached to the cover. The spray skirt protects the interior of the kayak under the cockpit frame 26.

The frame is assembled from cross-members 28, longitudinal stringers 24, the cockpit frame 26 and end-pieces 29. Longitudinal stringers 24, no longer than the sections of stringers comprising the cockpit frame 26, connect to these sections of stringers by means of smaller diameter ends fitting into larger diameter ends of stringers, in the case of aluminum tubing, for example. A seat 74 and two cross-members which may be made of marine plywood also comprise the cockpit frame 26 as well as the cockpit opening rim, formed by two bent aluminum sections. All parts of the cockpit frame are permanently fastened together and the seat is cushioned by a removeable closed-cell foam pad.

The sections of longitudinal stringers 24, may be made of a strong, corrosion-resistant aluminum alloy with short pieces of smaller diameter aluminum tubing snugly fitting inside and permanently fixed to the inside of the larger diameter tubing, leaving a smaller diameter end protruding equally as far as the smaller diameter pieces intrude, as a male fitting. This fitting snugly fits inside a joining stringer section having a larger diameter end so that the larger diameter parts meet and no edges are presented to harm the tightly-fitting cover. Smaller diameter fittings on both end-pieces 29 similarly fit stringer ends. Notched cross-members 28 insert among stringers 24 which may be fastened to the notched cross-members 28 and the end-pieces 29, in the case of chine and gunwale stringers, by means of straps with Velcro (a Trade Mark) hooked tape 33. Ends of the chine and gunwale stringers rest against recesses in the end-pieces 29.

OPERATION

Once the frame is taken from the carrying pack, it is centered and assembled, with respect to bow and stern parts, on top of the unfolded cover which is lying on a flat surface. The strap 16 from each end is attached and tightened to the cockpit frame 26. The eyelets and lacing adjacent the cockpit frame 73 are tightly fastened to the cockpit frame 26. The first set of fasteners 14, 15 are tightened to secure the gasket 18 along the deck ridge the full length of the deck and the second set of fasteners 10, 12 are tightened along the deck until the cover is pulled evenly and tightly over the chines, keelson, and gunwales, the full length of the kayak and the gasket 18 is sandwiched between the overlapping parts of the cover 32, 34. The overlapping part of the cover 34 is secured by the plurality of fasteners 10, 12 along the nearest gunwale and is released by these same fasteners for storage access to the kayak interior by means of openings between each fastener of the first set. The spray skirt 36 may be made of Neoprene as the gasket 18 may also be. The spray skirt 36 may fit tightly around the seated kayaker by means of Velcro (a Trade Mark) hooked tape fasteners which also may be quickly released in an emergency. The spray skirt is permanently attached to the cover. The kayak is now ready to be launched.

The second set of fasteners 10, 12 along both the forward and aft decks of the kayak permits easy access to both end sections for convenient loading of supplies inside the kayak as well as permitting easy re-distribution of weight throughout the entire length of the kayak. A carrying bag permits convenient carrying of the one-piece cockpit frame, with no moving parts, as well as the stringer sections, cross-members, end-pieces and the cover. The carrying bag as well contains room for such supplies as may be loaded in the kayak, once assembled. The foam pad for the kayak seat is inserted in the carrying pack, between the components of the kayak in the pack and the back of the carrying person. The kayak and the carrying pack are well-suited to touring needs, including camping and survival equipment.

The simplicity of the folding kayak covers manufacture of the cover and frame using hand tools entirely. Commercial manufacture of the cover and frame requires only simple hand-held power tools and a sewing machine. Covers and frames could be manufactured separately in private homes as a cottage industry. The cover design affords large tolerances in frame length, up to one inch, without affecting performance of the kayak.

The hull thickness could be increased for expedition use by inserting an additional layer of material between the frame and the cover, without modification to the original cover being necessary. The additional layer would be glued to the cover near the gunwales only, making a double hull which would give way to a puncturing object, providing watertight security. Additional strips of material, glued to the outside of the cover along chine and keelson lines provide protection to heavy wear parts of the cover where the cover cannot deflect slightly upon striking objects.

I claim:

1. A collapsible Kayak having a cover having access to a storage area in the interior of the assembled Kayak along the entire deck by means of fasteners which stretch the cover longitudinally and transversely over the frame, including:

(a) two sets of fasteners attached to the cover comprising lengths of material (b) a non-expanding frame including a deck ridge, (c) a flexible gasket attached to one edge of the cover which lies on the deck ridge the full length of the kayak and which is sandwiched between overlapping parts of the cover, whereby a first set of fasteners connect the one edge of the cover having a gasket on the deck ridge, the cover is then wrapped around the frame such that a portion of the cover is overlapped over the gasket, compressing it, to make a watertight seal, the second set of fasteners secure the overlapping part of the cover while permitting access to the storage area by release thereof.

2. A kayak having a cover as in claim 1 and a frame comprising:

(a) a cockpit frame constructed as a single unit by permanently fastening together a seat, two cross-members, a cockpit opening rim and longitudinal stringers corresponding to keelson, gunwales and chines, (b) tubular longitudinal stringer sections not longer than the stringers forming the cockpit frame, said stringer sections being attached to kayak end-pieces, the cockpit frame, and to each other by means of smaller diameter ends fitting snugly into larger diameter ends with no edges of the stringers being exposed, (c) said kayak end-pieces comprising an end piece at the bow and at the stern releaseably connected to the ends of the deck ridge, keelson, gunwale and chine stringers, (d) a plurality of cross-members located between the cockpit frame and the end-pieces at the bow and stern and attached to the deck ridge, keelson, chine, and gunwale stringers, such that when the end-pieces are detached from the stringer ends, cross-members are detached from the stringer sections, and stringer sections are detached from the cockpit frame and from themselves, the parts of the frame may be packed in a carrying bag along with the folded cover.

* * * * *